US007631763B1

(12) United States Patent
Brown

(10) Patent No.: US 7,631,763 B1
(45) Date of Patent: Dec. 15, 2009

(54) GOLF CLUB REMINDER METHOD

(76) Inventor: James D. Brown, 2319 Paseo Saucedal, Carlsbad, CA (US) 92009

( * ) Notice: Subject to any disclaimer, the term of this patent is extended or adjusted under 35 U.S.C. 154(b) by 270 days.

(21) Appl. No.: 11/530,304

(22) Filed: Sep. 8, 2006

(51) Int. Cl.
*A63B 55/00* (2006.01)
*A63B 57/00* (2006.01)

(52) U.S. Cl. ..... 206/527; 206/315.3; 206/315.6; 116/173; 473/407; 473/409

(58) Field of Classification Search ..... 206/315.6, 206/315.3, 527; 116/173; 473/409, 407; 224/742
See application file for complete search history.

(56) References Cited

U.S. PATENT DOCUMENTS

D266,832 S 11/1982 Brown
4,542,757 A * 9/1985 Phillips ..... 135/16
4,944,396 A * 7/1990 Larkin ..... 206/315.6
5,403,219 A * 4/1995 Ryan ..... 441/11
5,540,181 A * 7/1996 Pearce ..... 116/173
5,862,773 A 1/1999 Kaufman
5,881,481 A 3/1999 Bashaw, Jr. et al.
D410,518 S * 6/1999 Didier et al. ..... D21/789
6,023,225 A * 2/2000 Boley et al. ..... 340/568.6
6,383,095 B1 * 5/2002 Azotea ..... 473/406
6,497,327 B1 * 12/2002 Rindfleisch ..... 211/70.2
6,626,293 B2 9/2003 St. Jeor
6,929,124 B2 * 8/2005 Kawasaki ..... 206/315.2
7,205,894 B1 * 4/2007 Savage ..... 340/568.6
2003/0200912 A1 10/2003 Brock, Jr.
2004/0099295 A1 * 5/2004 You ..... 135/16
2004/0163458 A1 * 8/2004 Lapkin ..... 73/170.05
2004/0244670 A1 12/2004 Young
2005/0066876 A1 * 3/2005 Ritchey ..... 116/201
2007/0093311 A1 * 4/2007 Fletcher ..... 473/282

FOREIGN PATENT DOCUMENTS

CA 2131781 A * 3/1995

* cited by examiner

*Primary Examiner*—Sue A Weaver

(57) ABSTRACT

A golf club reminder method includes providing a golf bag that has an upper edge. A plurality of golf clubs is positioned in the golf bag. A post has a bottom end and a top end. A flag is attached to the post adjacent to the top end of the post. The flag has indicia thereon indicating a reminder to verify all golf clubs are accounted for. A coupler is attached to the bottom end of the post. The post is attached to the golf bag adjacent to the upper edge with the coupler and the post extended upwardly from the golf bag. The post is thereby attached to the golf bag during a round of golf.

5 Claims, 2 Drawing Sheets

GOLF CLUB REMINDER METHOD

BACKGROUND OF THE INVENTION

1. Field of the Invention

The present invention relates to club reminder devices and more particularly pertains to a new club reminder device for reminding a golfer to return all of his or her golf clubs to a golf bag after a golf hole is completed.

2. Description of the Prior Art

The use of club reminder devices is known in the prior art. While these devices fulfill their respective, particular objectives and requirements, the need remains for a device reminding a golfer to verify that all golf clubs are accounted for in a manner that is efficient, inexpensive and non-obtrusive. Further, the device should not require alteration of the golf bag used by the golfer.

SUMMARY OF THE INVENTION

The present invention meets the needs presented above by generally providing a golf bag that has an upper edge. A plurality of golf clubs is positioned in the golf bag. A post has a bottom end and a top end. A flag is attached to the post adjacent to the top end of the post. The flag has indicia thereon indicating a reminder to verify all golf clubs are accounted for. A coupler is attached to the bottom end of the post. The post is attached to the golf bag adjacent to the upper edge with the coupler and the post extended upwardly from the golf bag. The post is thereby attached to the golf bag during a round of golf.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
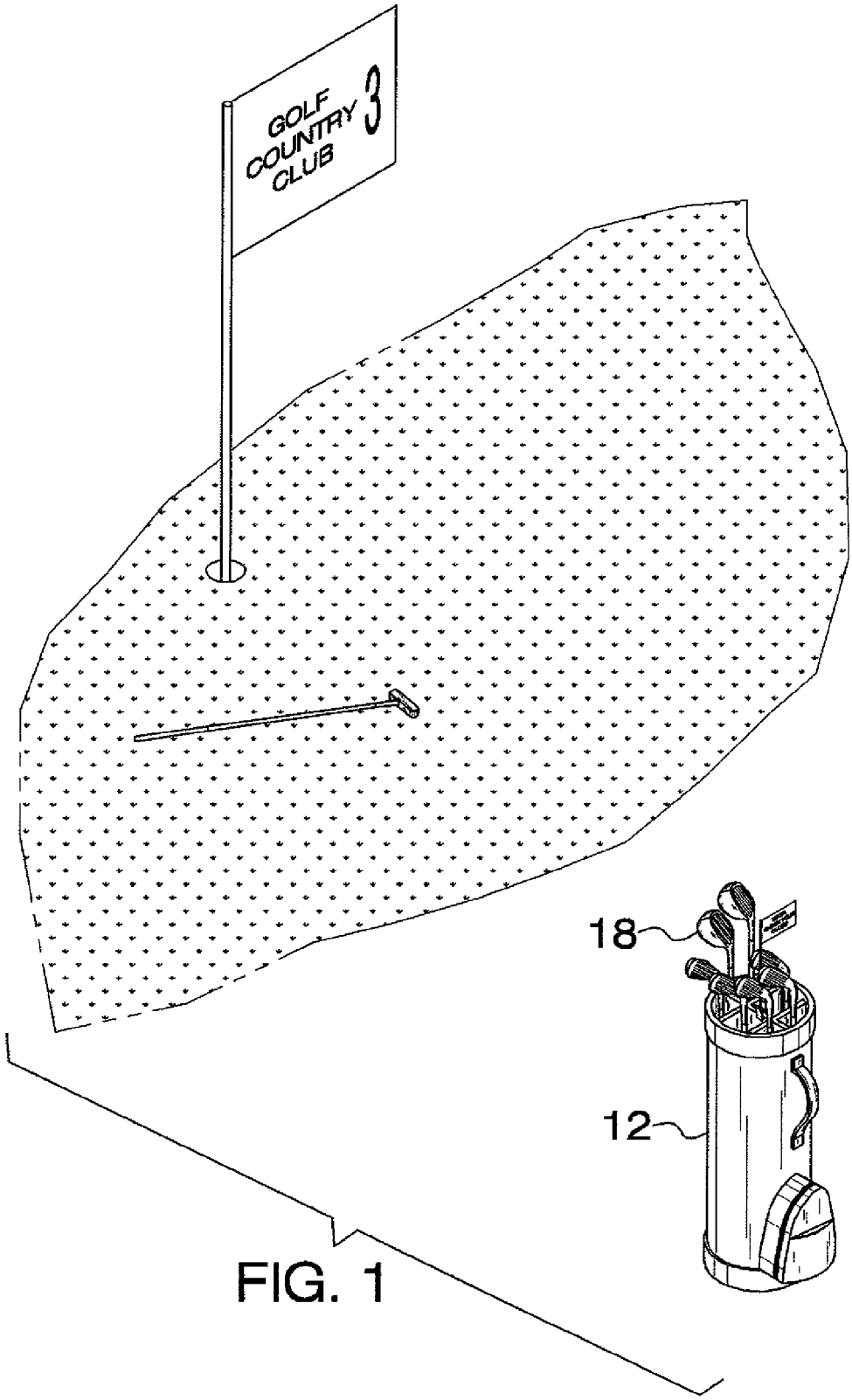
FIG. 1 is a perspective in-use view of a golf club reminder method according to the present invention.
Figure 2:
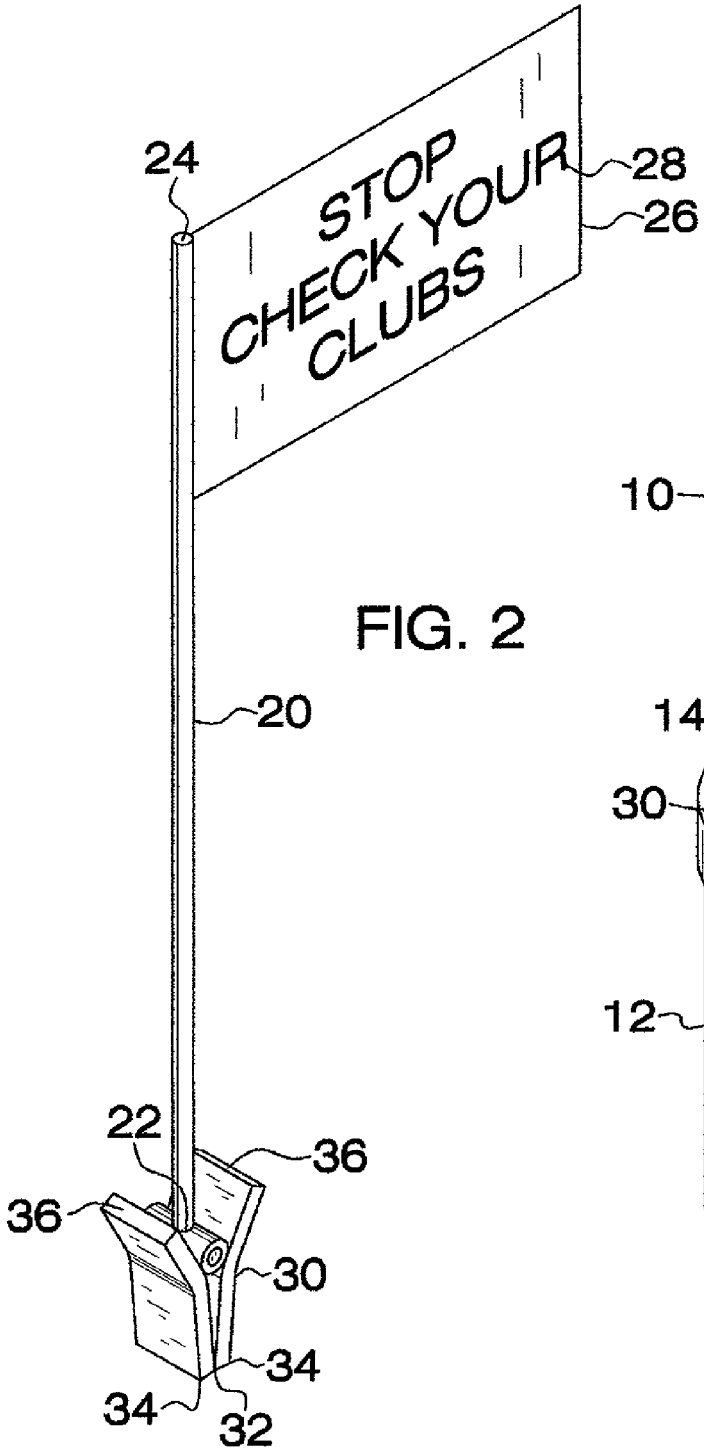
FIG. 2 is a perspective view of a flag and coupler of the present invention.
Figure 3:
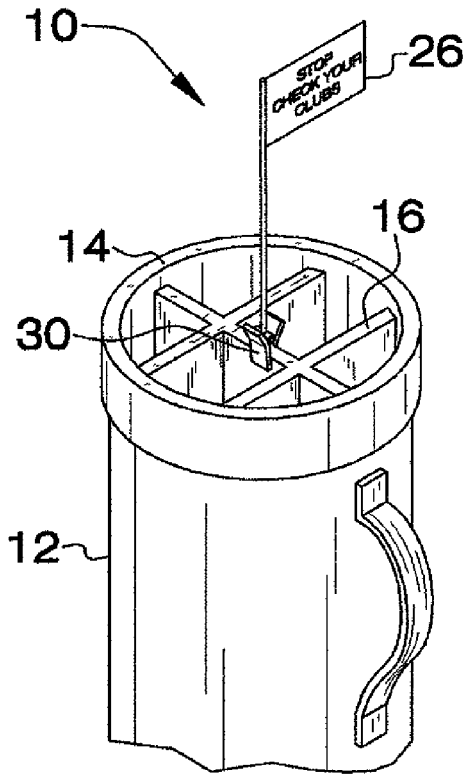
FIG. 3 is a perspective in-use view of the present invention.

With reference now to the drawings, and in particular to FIGS. 1 through 3 thereof, a new club reminder device embodying the principles and concepts of the present invention and generally designated by the reference numeral 10 will be described.

As best illustrated in FIGS. 1 through 3, the golf club reminder method 10 generally comprises providing a golf bag

12 that has an upper edge 14 and a plurality of club dividers 16 therein. A plurality of golf clubs 18 is positioned in the golf bag 12.

A post 20 is providing that has a bottom end 22 and a top end 24. The post 20 has a height between 6 inches and 8 inches. A flag 26 is attached to the post 20 adjacent to the top end 24 of the post 20. The flag 26 has indicia 28 thereon indicating a reminder to verify all golf clubs 18 are accounted for. In particular, the indicia 28 may ask a golfer to stop and check their clubs 18. The flag 26 is comprised of a synthetic cloth material.

A coupler 30 is attached to the bottom end 22 of the post 20. The coupler 30 comprises a clip having a receiving end 32 directed downwardly from the post 20. The coupler 30 may be a conventional clip including jaws 34 biased against each other and finger grips 36 for urging the jaws 32 apart.

During or before a round of golf, the post 20 is attached to the golf bag 12 adjacent to the upper edge 14 with the coupler 30. The post 20 may be attached to the upper edge 14 or to the club dividers 16. The post 20 is orientated so that it extends upwardly from the golf bag 12. Every time a golfer returns a golf club 18 to the golf bag 12, or goes to the golf bag 12 to retrieve a golf club 18, the golfer will be reminded to verify that they have possession of all of their golf clubs 18. In particular, this will prevent the golfer from leaving a golf club 18 greenside, such as a pitching wedge or putter, when the golfer finishes a hole.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of signaling to a golfer to verify that a golf club count, said method including the steps of:

providing a golf bag, said golf bag having an upper edge;

providing a plurality of golf clubs being positioned in said golf bag;

providing a post having a bottom end and a top end;

providing a flag being attached to said post adjacent to said top end of said post, said flag having indicia thereon indicating a reminder to verify all golf clubs are accounted for;

providing a coupler being attached to said bottom end of said post, said top end of said post having a fixed distance from said coupler; and attaching said post to said golf bag adjacent to the upper edge with said coupler and extending said post upwardly from said golf bag so that said post is attached to said golf bag during a round of golf.

2. The method according to claim 1, wherein the step of providing a post includes the step of said post having a height between 6 inches and 8 inches.

3. The method according to claim 1, wherein the step of providing a flag includes the step of said flag being comprised of a synthetic cloth material.

4. The method according to claim 1, wherein the step of providing a coupler includes the step of said coupler comprising a clip having a receiving end directed downwardly from said post.

5. A method of signaling to a golfer to verify that a golf club count, said method including the steps of:

providing a golf bag, said golf bag having an upper edge and a plurality of club dividers therein;

providing a plurality of golf clubs being positioned in said golf bag;

providing a post having a bottom end and a top end, said post having a height between 6 inches and 8 inches;

providing a flag being attached to said post adjacent to said top end of said post, said flag having indicia thereon indicating a reminder to verify all golf clubs are accounted for, said flag being comprised of a synthetic cloth material;

providing a coupler being attached to said bottom end of said post, said coupler comprising a clip having a receiving end directed downwardly from said post, said top end of said post having a fixed distance from said coupler; and attaching said post to said golf bag adjacent to the upper edge with said coupler and extending said post upwardly from said golf bag so that said post is attached to said golf bag during a round of golf.

* * * * *